US006941066B2

(12) United States Patent
Kawakami

(10) Patent No.: US 6,941,066 B2
(45) Date of Patent: Sep. 6, 2005

(54) CAMERA CASE

(75) Inventor: Takashi Kawakami, Uji (JP)

(73) Assignee: Ogram Design Co., Ltd., Kyoto (JP)

( * ) Notice: Subject to any disclaimer, the term of this patent is extended or adjusted under 35 U.S.C. 154(b) by 0 days.

(21) Appl. No.: 10/626,816

(22) Filed: Jul. 23, 2003

(65) Prior Publication Data

US 2005/0019029 A1 Jan. 27, 2005

(51) Int. Cl.[7] ..... G03B 17/08
(52) U.S. Cl. ..... 396/27; 396/29; 396/535
(58) Field of Search ..... 396/25–29, 535

(56) References Cited

U.S. PATENT DOCUMENTS

| | | | | |
|---|---|---|---|---|
| 4,918,472 A | * | 4/1990 | Reed | 396/28 |
| 6,075,944 A | * | 6/2000 | Balling et al. | 396/6 |
| 6,397,012 B1 | * | 5/2002 | Nishimura et al. | 396/176 |

FOREIGN PATENT DOCUMENTS

| | | |
|---|---|---|
| JP | 3000374 U | 6/1994 |
| JP | 7-1445 U | 1/1995 |
| JP | 3046325 U | 12/1997 |
| JP | 11-142933 | 5/1999 |
| JP | 2000-194062 A | 7/2000 |
| JP | 2000-321721 A | 11/2000 |
| JP | 2001-91996 A | 4/2001 |

* cited by examiner

*Primary Examiner*—David M. Gray
(74) *Attorney, Agent, or Firm*—Christensen O'Connor Johnson Kindness PLLC

(57) ABSTRACT

This invention provides a camera case for stopping degradation of picture quality even if pictures are taken with a camera still in the case. Also, this invention provides a camera case with which it is possible to smoothly remove a strap from the case body.

For example, a bent section is provided in a case body. Even if light emitted from a flash enters a thickened part of the case body, the light is diverged to the outside by the bent section. In this way, the amount of light transmitted from the flash to the lens of the camera is reduced. Further, a rib may be provided in the case body. In this way, light emitted from the flash and reflected by the inner surface of the case body is inhibited from reaching the lens of the camera. A strap is also supported by support pieces. If a strong tensile force is applied to the strap, the support pieces are deformed and the strap and the case body are separated.

8 Claims, 12 Drawing Sheets

CAMERA CASE

BACKGROUND OF THE INVENTION

1. Field of the Invention

The present invention relates to a camera case that can be used with a camera (for example, a film with lens).

2. Description of the Related Art

As a case for a film with lens, there has been proposed a case that enables pictures to be taken with the case still attached to the film with lens. This case has the following problems.

(1) It is easy for light from a flash to go around the lens via the case. If the light goes around the lens, the quality of photographs taken is degraded due to the effects of this light. There are two causes of this light going around the lens. One is that light is reflected by the inside of the case. The other is due to a pipeline effect where light passes through the thickness of the case.

(2) The case often has a strap. With a conventional case, a strap is attached firmly to the case body. However, when the strap can be worn around the neck, it is desirable to avoid having a strong force act on the person's body via the case body or the strap. In order to achieve this, it is desirable for the strap and the case body to separate when a strong tensile force is applied to the strap.

The present invention has been conceived in view of the above described situation. A first object of the present invention is to provide a camera case that can improve the quality of photographs. A second object of the present invention is to provide a camera case where it is possible for a strap and a case body to separate smoothly when a strong tensile force is applied.

SUMMARY OF THE INVENTION

A camera case of the present invention has a camera storage space and a inhibiting section. The inhibiting section is constructed to inhibit light emitted from a camera flash stored in the storage space from being transmitted to a lens of the camera.

The camera case of the present invention can also be provided with a transparent section for a lens and a transparent section for a flash. In this case, the transparent section for a lens and the transparent section for a flash can be arranged at positions corresponding to a camera lens and a flash stored in the storage space. It is also possible for the inhibiting section to be arranged between the transparent section for a lens and the transparent section for a flash.

The inhibiting section can be a rib projecting in an inward direction of the storage space.

It is also possible for the inhibiting section to be a bent section formed by bending the camera case itself.

The inhibiting section can also be a slit formed in the camera case.

It is also possible for the camera case of the present invention to have the following structure. Specifically, this case has a camera storage space and an inhibiting section. The inhibiting section is constructed to inhibit light emitted from a camera flash stored in the storage space from being transmitted to a sensor of the camera.

This camera case can also be provided with a transparent section for a flash and a transparent section for a sensor. The transparent section for a flash and the transparent section for a sensor can be arranged at positions corresponding to a camera flash and a sensor stored in the storage space. The inhibiting section can be arranged between the transparent section for a flash and the transparent section for a sensor.

It is possible for the inhibiting section to be a slit formed in the camera case.

The sensor can be a distance sensor.

The transparent section for a lens and the transparent section for a flash may be separated in the horizontal direction, and the rib may extend in a vertical direction of the storage space.

The rib may extend to close to upper and lower ends of the storage space.

The inhibiting section may comprise a rib projecting towards the inside of the storage space and a bent section formed by bending the camera case itself, the bent section being formed in a step shape having a section at the camera flash side further inwards than a section at the camera lens side, and the rib being arranged closer to the lens than the curved section.

The transparent section for a flash may be a through hole.

The inhibiting section may be an indented section formed around the transparent section for a lens.

The inhibiting section may be an indented section formed around the transparent section for a sensor.

The camera case of the present invention can also have the following structure. Specifically, this case is provided with a case body and a strap attached to the case body. The case body has a support piece for supporting the strap. The support piece is capable of deformation under tensile force acting between the strap and the case body.

This camera case can be further provided with a contact section for contacting the support piece that has been deformed by the tensile force.

The support piece can be provided with a weakening section for making deformation of the support piece easy.

The strap can become capable of being removed from the case body as a result of deformation of the support piece.

DESCRIPTION OF THE PREFERRED EMBODIMENTS

Figure 1:
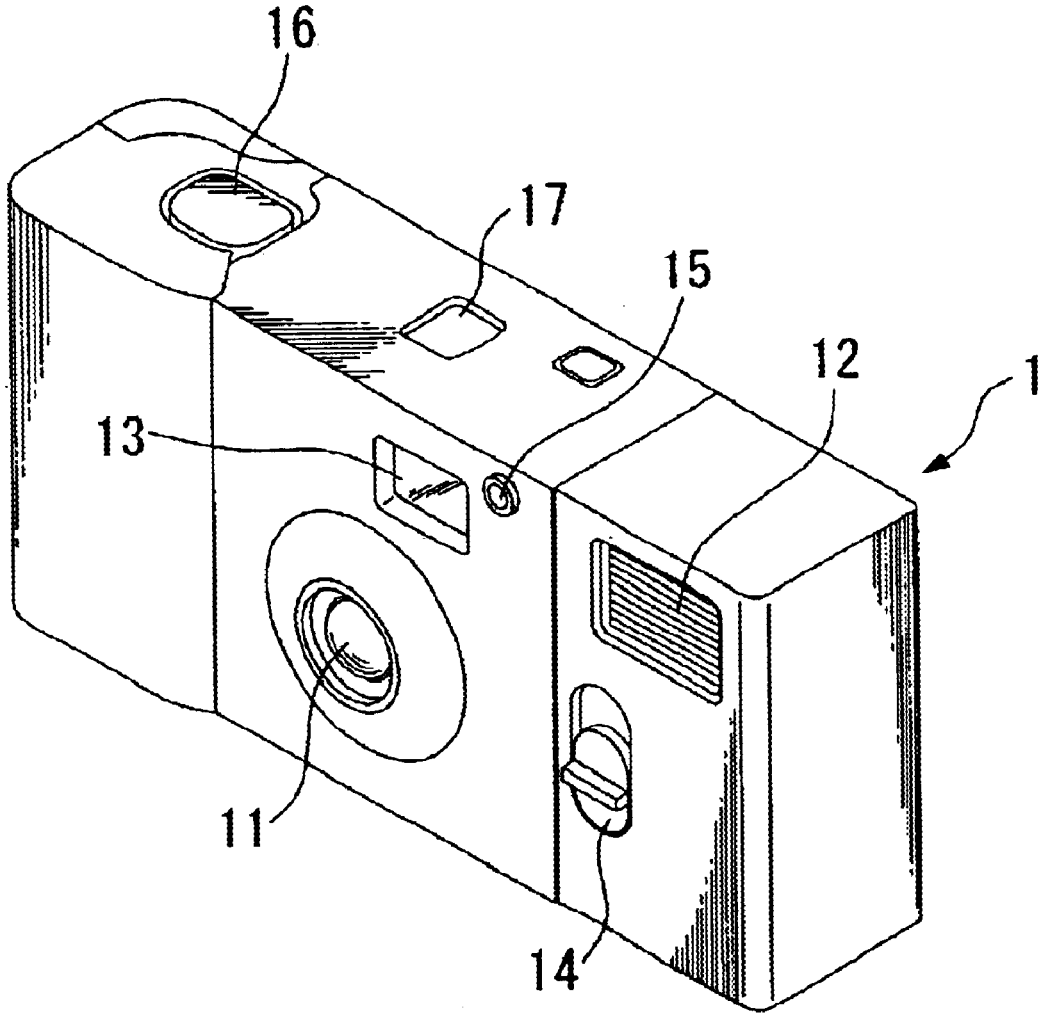
FIG. 1 is a schematic front elevation of a film-with-lens as an example of a camera.

A camera case of an embodiment of the present invention will now be described with reference to the attached drawings. First of all, the film-with-lens 1 as one example of a camera stored in this camera case will be described based on FIG. 1. This film-with-lens 1 is a well known camera provided with a camera lens 11, a flash 12, a viewfinder 13, a flash switch 14, a distance sensor 15, a shutter button 16 and a display window 17 for the number of exposures remaining. This film-with-lens 1 measures a distance to a photographic subject using the distance sensor 15 and adjusts the light emission conditions of the flash.

Figure 2:
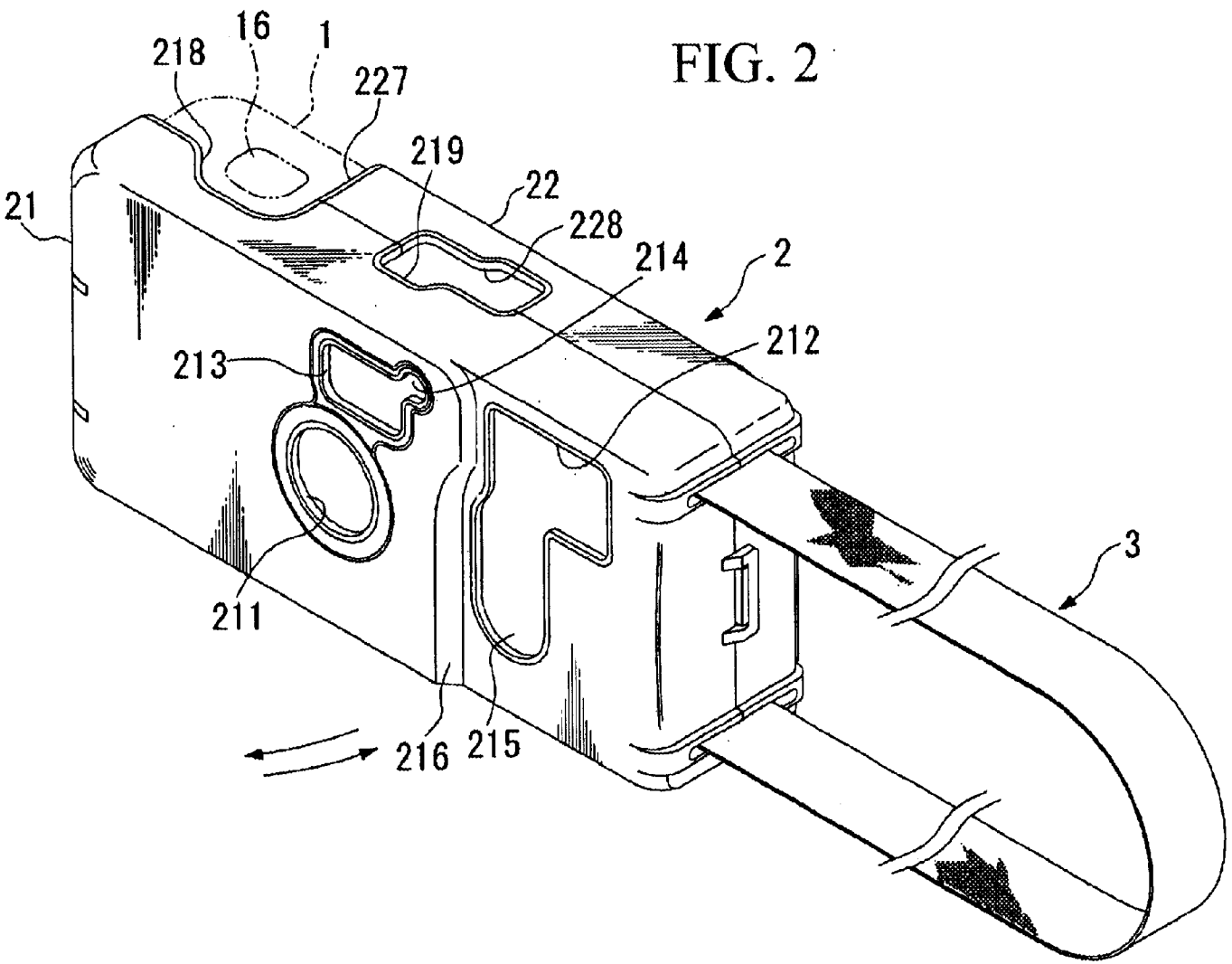
FIG. 2 is a schematic perspective view of a camera case of one embodiment of the present invention.
Figure 3A:
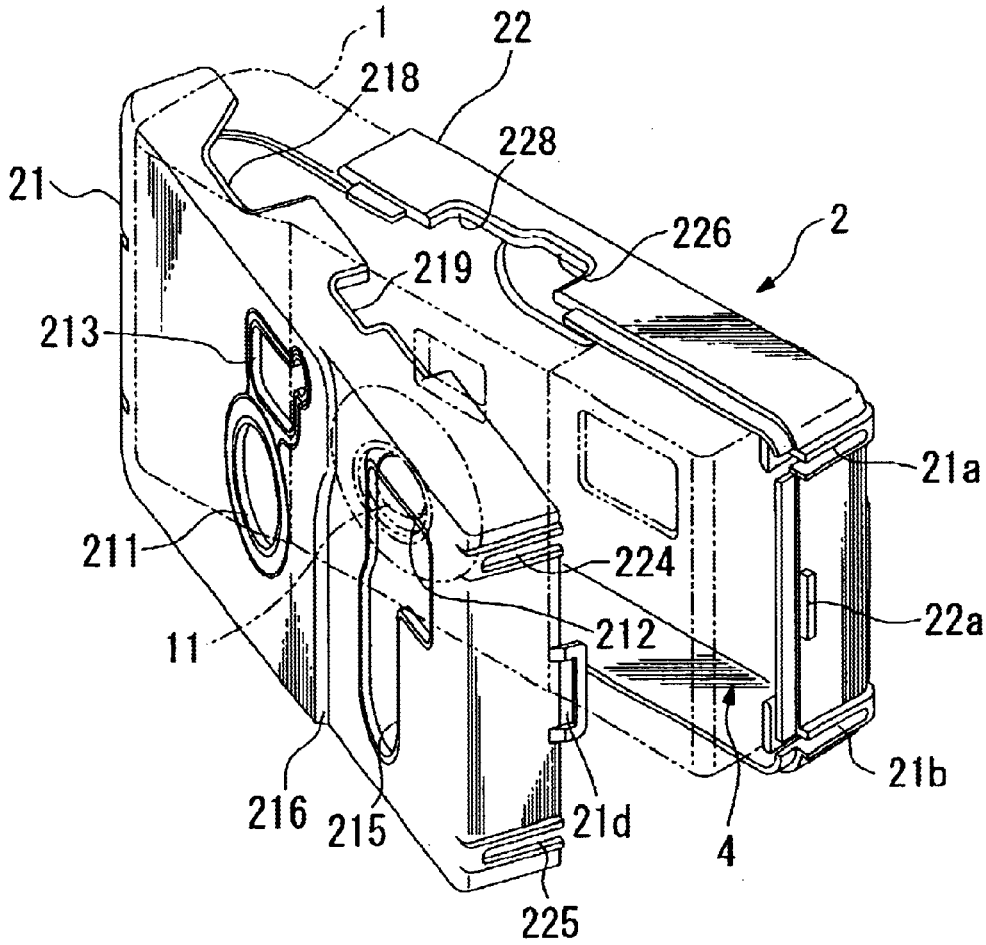
FIG. 3A is a schematic perspective view of the camera case of FIG. 2, showing a state where an internal storage space is open.
Figure 3B:
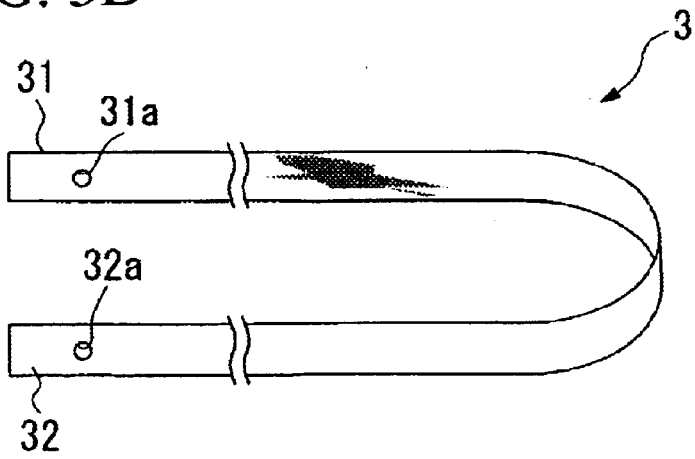
FIG. 3B is a schematic explanatory drawing of a strap in a state of being removed from the case body.

The camera case of this embodiment is provided with a case body 2 and a strap 3 (refer to FIG. 2 and FIG. 3). The case body 2 is provided with an internal storage space 4 for storing the film-with-lens 1 (camera). The case body 2 is mainly composed of a front case body 21 and a rear case body 22 (refer to FIG. 2–FIG. 4). An end part of the front case body 21 is attached to an end part of the rear case body 22 in such a way that it can be opened and closed (refer to FIG. 3). It is possible to use a semi-transparent or transparent resin, for example, as the material for the case body 2, but the material is not limited.

Figure 8:
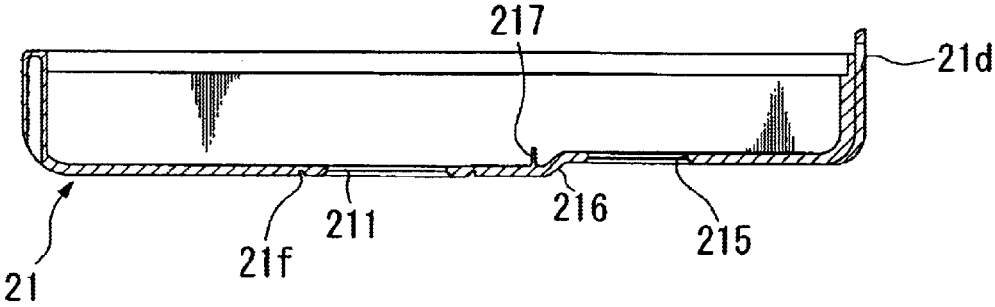
FIG. 8 is a cross section along the line A—A in FIG. 5.
Figure 9:
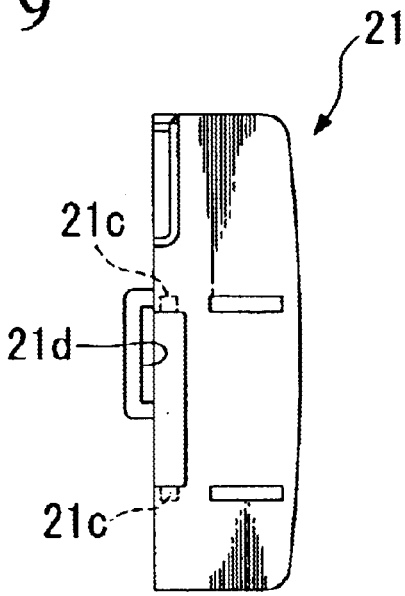
FIG. 9 is a left side view of FIG. 5.
Figure 10:
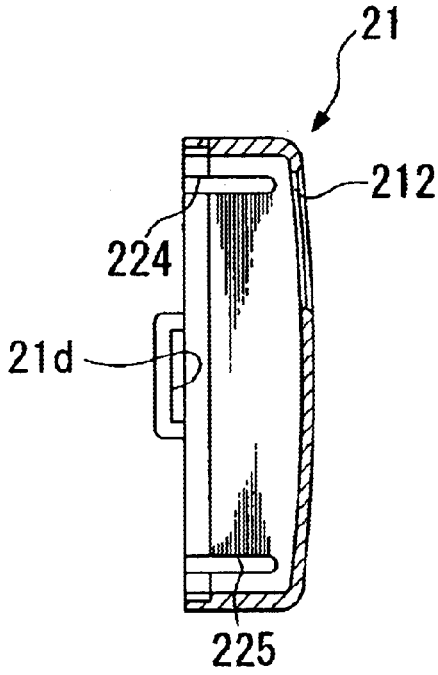
FIG. 10 is a cross section along the line B—B in FIG. 5.

As shown in FIG. 5–FIG. 10, the front case body 21 is provided with a lens hole (corresponding to a transparent section for a lens) 211, a flash hole (corresponding to a transparent section for a flash) 212, a viewfinder hole 213, a sensor hole (corresponding to a transparent section for a sensor) 214, a switch hole 215, a bent section (corresponding to the inhibiting section) 216 (refer to FIG. 8), a rib (corresponding to the inhibiting section) 217, a shutter button cut-away 218 (refer to FIG. 7), a display cut-away 219, strap grooves 21*a* and 21*b* (refer to FIG. 10), a boss hole 21*c*, and engagement hole 21*d* (refer to FIG. 8–FIG. 10).

The lens hole 211 is provided at a position corresponding to the lens 11 of the film-with-lens 1 in a state where the film-with-lens 1 is stored in the storage space 4. Similarly, the flash hole 212, viewfinder hole 213, sensor hole 214, and switch hole 215 are provided at positions corresponding to the flash 12, viewfinder 13, sensor 15 and switch 14 of the film-with-lens 1. The lens hole 211, flash hole 212, viewfinder hole 213 and sensor hole 214 are made through holes in this embodiment. However, as long as light necessary for taking photographs can pass through, it is possible to use, for example, a transparent material instead of these holes.

Figure 4:
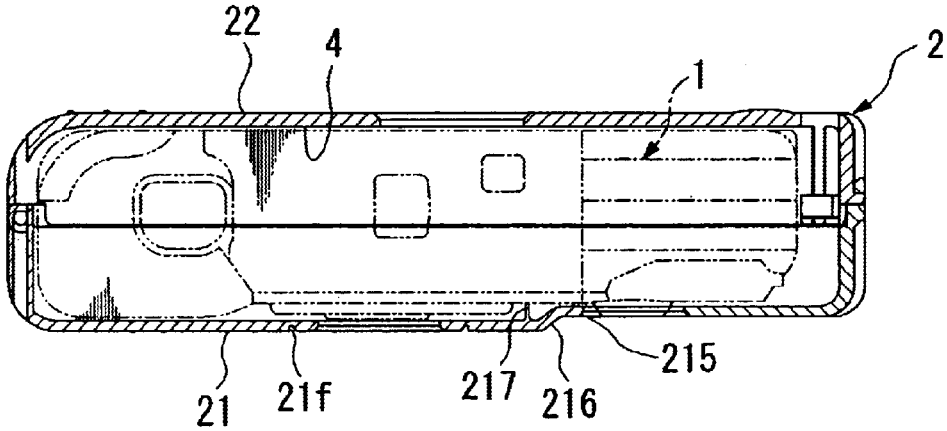
FIG. 4 is a schematic cross sectional view of a state where a camera is stored in the camera case of FIG. 2.
Figure 5:
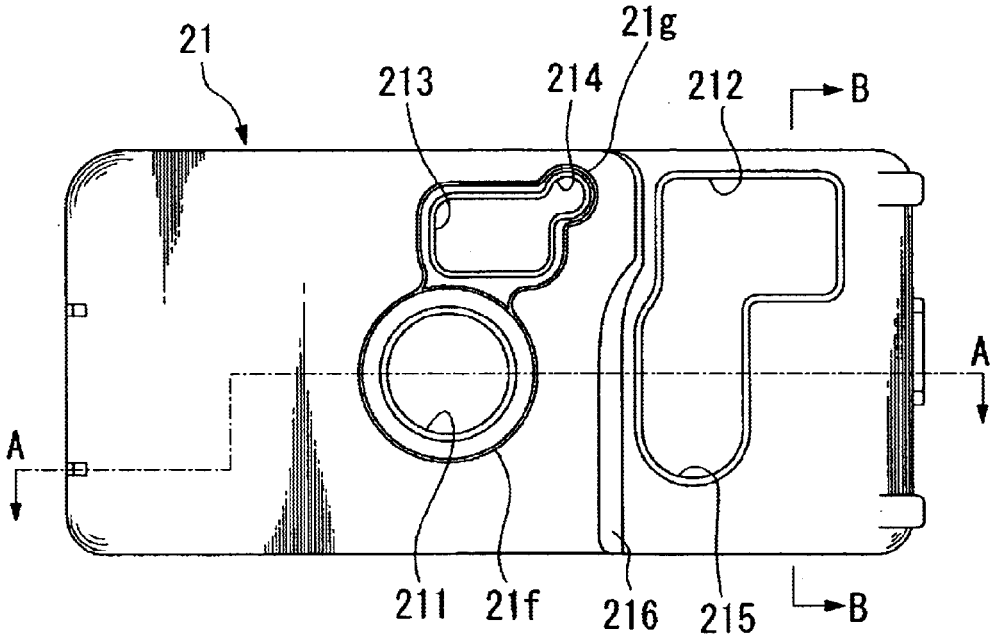
FIG. 5 is a front elevation of a front case body used in the camera case of FIG. 2.
Figure 6:
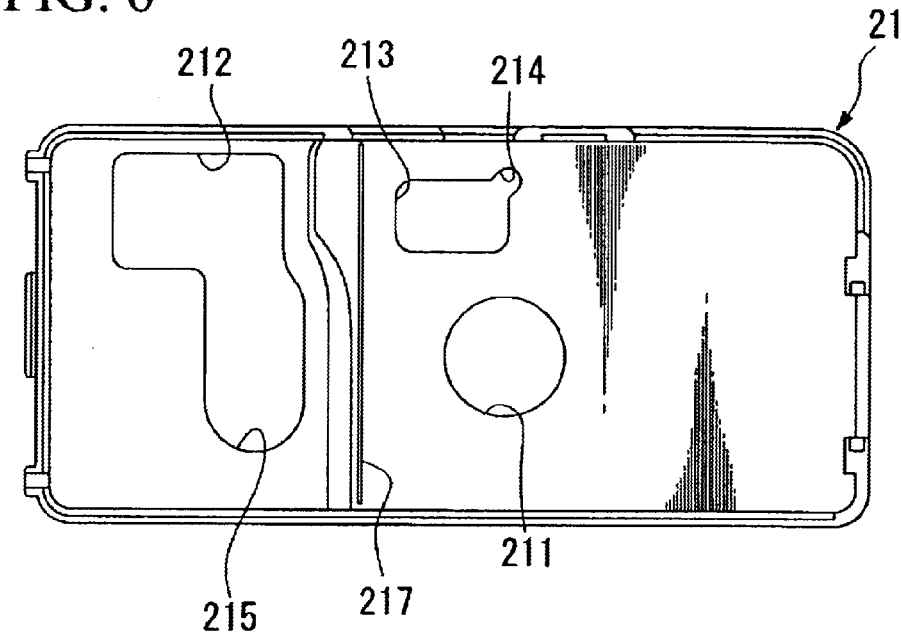
FIG. 6 is a rear view of FIG. 5.
Figure 7:
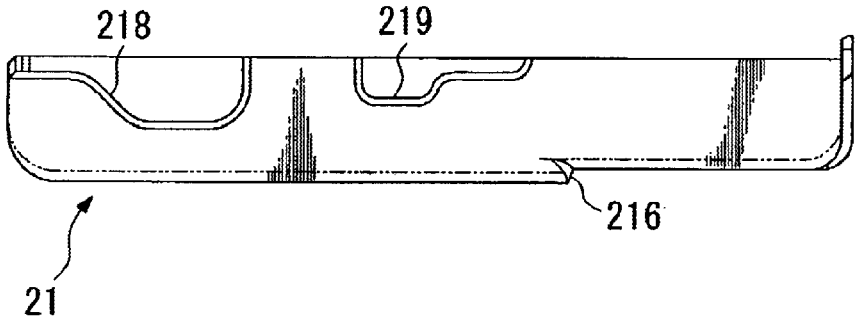
FIG. 7 is a plan view of FIG. 5.

An indented section 21*f* is formed around the lens hole 211 (refer to FIG. 4, FIG. 5 and FIG. 8). The indented section 21*f* has a thin groove shape, and forms a ring substantially concentric with the lens hole 211 (refer to FIG. 5).

An indented section 21*g* is formed around the lens hole 211 (refer to FIG. 5). Similarly to the indented section 21*f*, the indented section 21*g* has a thin groove shape.

It is possible to embed material having a refractive index or light absorption spectrum that is different to that of the front case body 2 inside these indented sections 21*f* and 21*g*.

As shown in FIG. 8, the bent section 216 is formed by bending the front case body 21 itself (that is, the case body 2 itself). The bent section 216 is arranged between the lens hole 211 and the flash hole 212 (refer to FIG. 5). Also, the bent section 216 extends in a vertical direction of the case body 2 (up and down direction in FIG. 5).

The bent section 216 is formed in a step shape with a section at the flash 12 of the film-with-lens 1 side being further inwards than a section at the lens 11 side (refer to FIG. 4).

The rib 217, as shown in FIG. 8, is provided on an inner surface of the front case body 21. In this way, the rib 217 is formed projecting the case body 2 in an inward direction of the storage space 4. The rib 217 is preferably made from a material that can attenuate or reflect transmission of light from the flash 12. The rib 217 is arranged between the lens hole 211 and the flash hole 212 that are separated in the horizontal direction, and extends in a vertical direction of the case body 2 (vertical direction in FIG. 6). Both upper and lower ends of the rib 217 extend almost to positions reaching the upper and lower ends of the camera storage space 4 (refer to FIG. 6). Also, the rib 217 is positioned closer to the lens 11 than the step-shaped bent section 216 (refer to FIG. 4 and FIG. 8.

The shutter button cut-away 218 and the display cut-away 219 are combined with corresponding sections of the rear case body 22, which will be described later, to allow the shutter button and display section of the film-with-lens 1 to be exposed to the outside (refer to FIG. 2).

The strap grooves 21*a* and 21*b* are for passing the strap 3 through. The boss hole 21*c* is for housing a shaft (boss) of the rear case body 22, which will be described later.

The engagement hole 21*d* engages with an engagement projection 22*a* of the rear case body 22, which will be described later, to support the front case body 21 and the rear case body 22 in a closed state.

The rear case body 22 comprises support pieces 221 and 222, ribs 2231 and 2231, strap grooves 224 and 225, a viewfinder hole 226, a cut-away section 227 for the shutter button and film wind-on dial, a display cut-away section 228, a shaft (boss) 229, and an engagement projection 22*a*.

Figure 11:
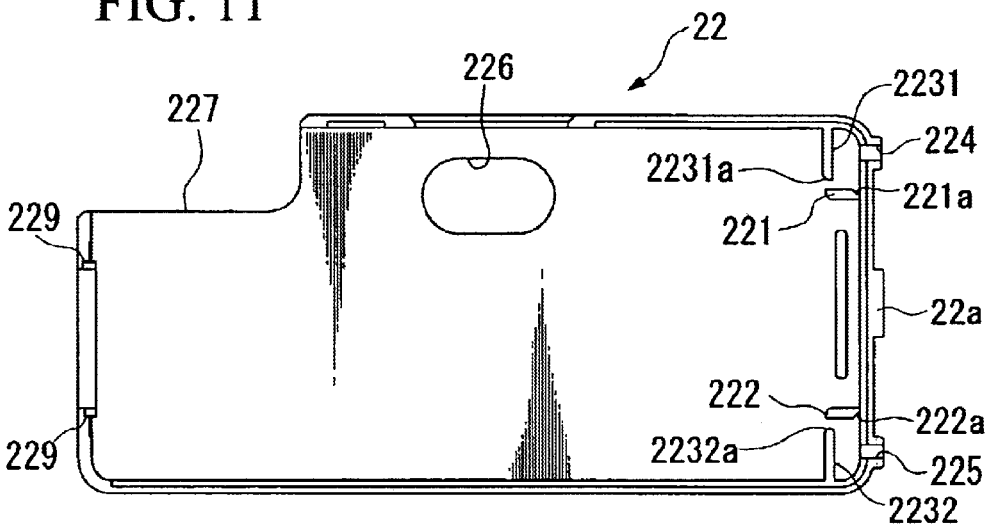
FIG. 11 is a front elevation of a rear case body used in the camera case of FIG. 2, looking from the storage space side.
Figure 12:
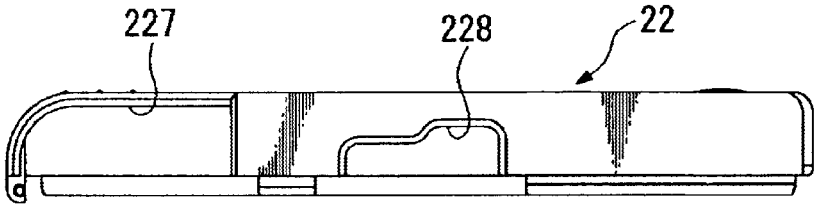
FIG. 12 is a plan view of FIG. 11.
Figure 13:
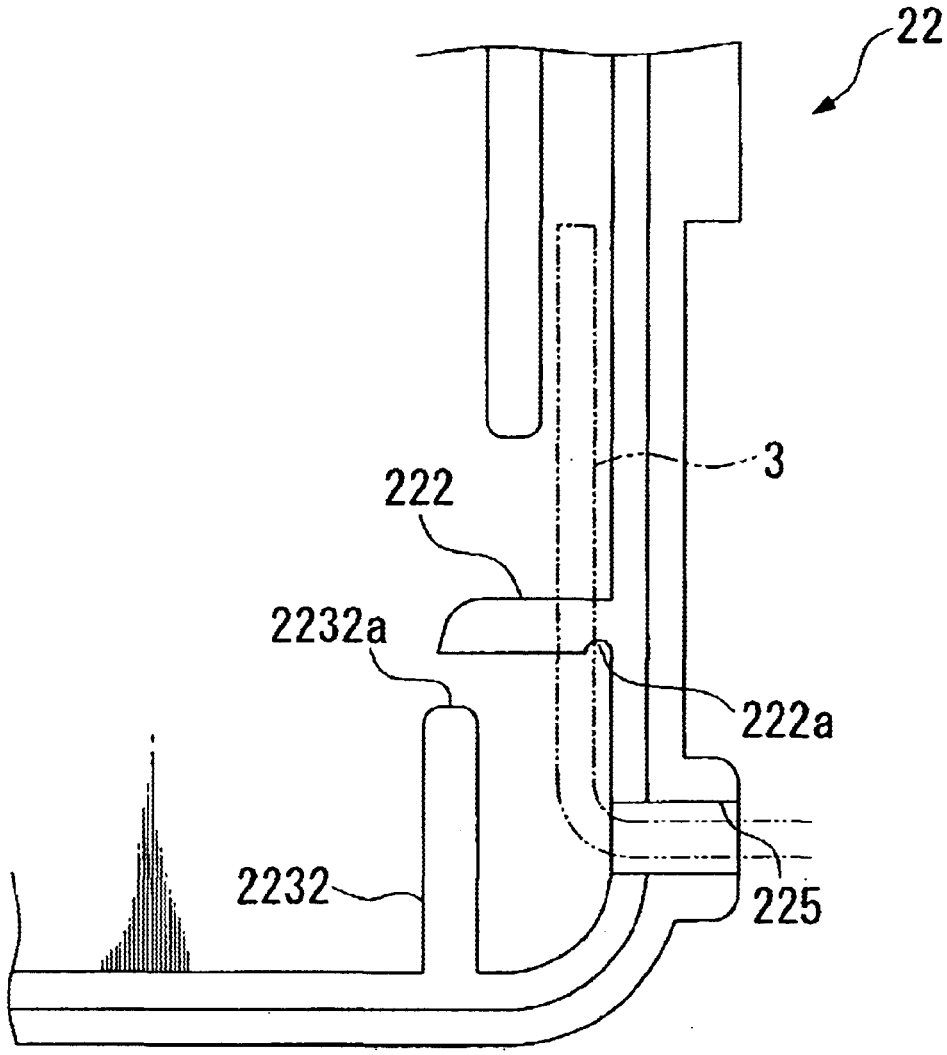
FIG. 13 is an expanded view of essential parts of FIG. 11.
Figure 14:
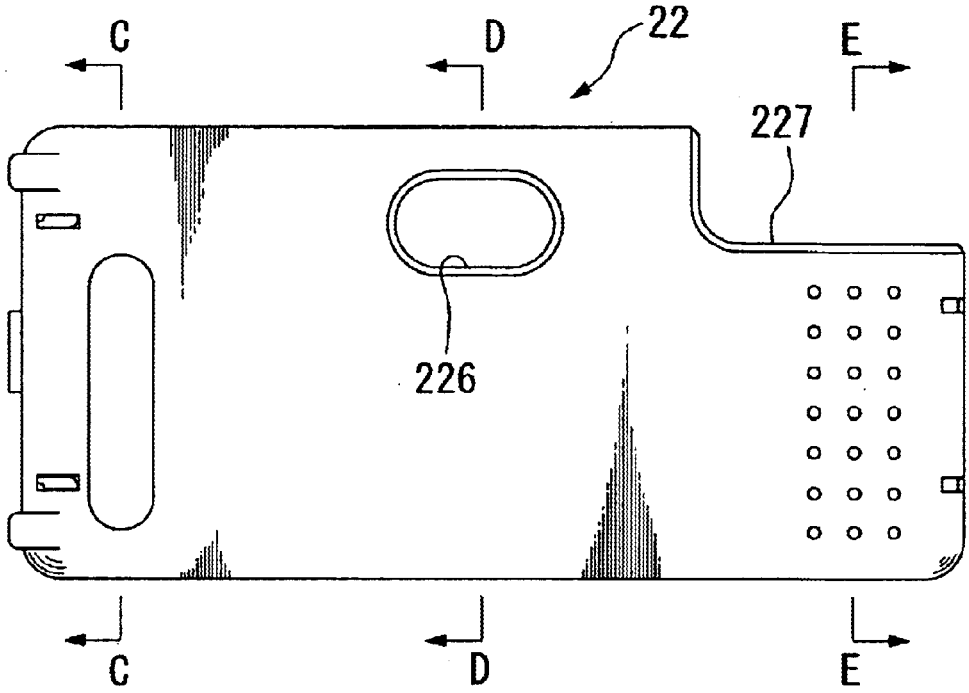
FIG. 14 is a rear view of FIG. 11.
Figure 15:
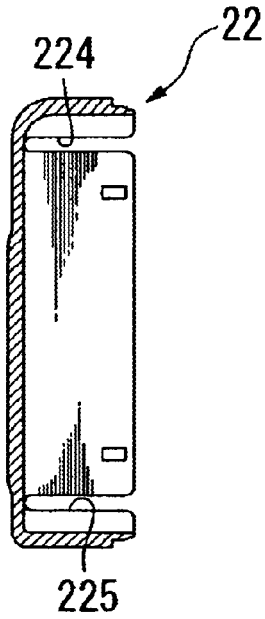
FIG. 15 is a cross section along the line C—C in FIG. 14.
Figure 16:
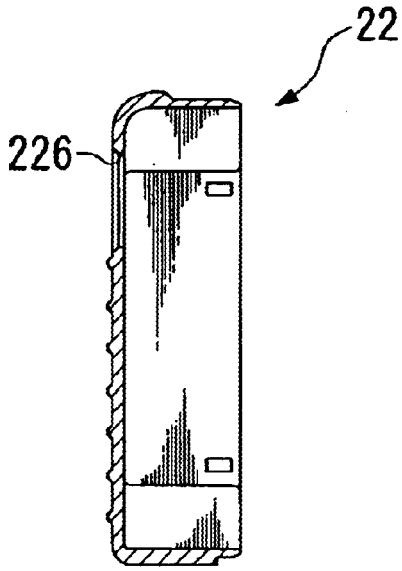
FIG. 16 is a cross section along the line D—D in FIG. 14.
Figure 17:
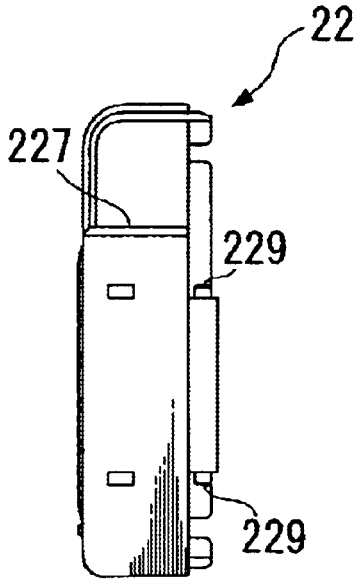
FIG. 17 is a right side view of FIG. 14.
Figure 18:
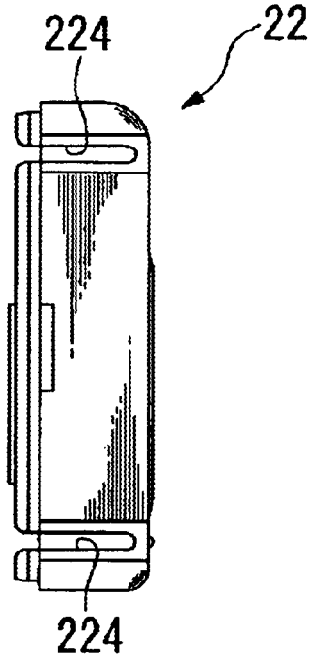
FIG. 18 is a left side view of FIG. 14.
Figure 19:
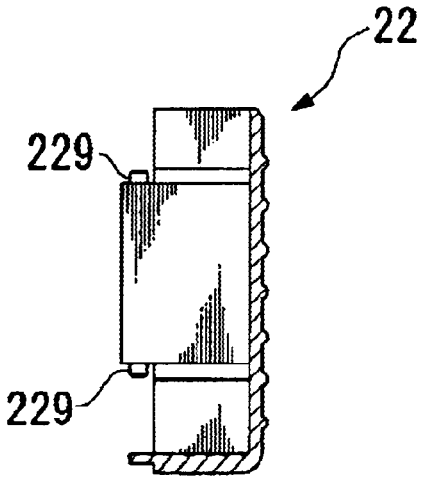
FIG. 19 is a cross section along the line E—E in FIG. 14.

As shown in FIG. 11 and FIG. 13, the support pieces 221 and 222 are respectively provided projecting in an inward direction on the inner surface of a side wall of the rear case body 22. The support pieces 221 and 222 are inserted into holes 31*a* and 32*a* (refer to FIG. 3*b*) formed in the strap end sections 31 and 32. Weakening sections 221*a* and 222*a* are respectively formed on the support pieces 221 and 222. With this embodiment, these weakening sections 221*a* and 222*a* are notches formed in the support pieces 221 and 222 (refer to FIG. 13).

The rib 2231 is formed in a side wall inner surface of the rear case body 22, and extends in a direction orthogonal to the support piece 221. Similarly, the rib 2232 is formed on a side wall inner surface of the rear case body 22, and extends in a direction orthogonal to the support piece 222. The two ends of the ribs 2231 and 2232 constitute contact sections 2231*a* and 2232*a* for contacting the support pieces 221 and 222 deformed by tensile force on the strap 3.

The viewfinder hole 226 is provided at a position corresponding to the viewfinder 13 of the film-with-lens I, similarly to the viewfinder hole 213 of the front case body 21.

The cut-away section 227 for the shutter button and the film wind-on dial is provided at a position corresponding to the shutter button 16 and film wind-on dial of the film-with-lens 1. In this way, it becomes possible to operate the shutter button 16 and the film wind-on dial.

The display cut-way section 228 is provided at a position corresponding to the display window 17 of the film-with-lens 1 for remaining exposures. In this way, it is possible to confirm how many film exposures are left.

The shaft 229 is a so-called boss, and is fitted into the boss hole 21*c*. In this way, it becomes possible to join the front case body 21 and the rear case body 22 in a hinged manner.

The engagement projection 22*a* is fitted into the engagement hole 21*d*, as previously described.

Next, a method of using the camera case of this embodiment will be described. First of all, the lens-with-film 1 is stored in the storage space 4 of the camera case (refer to FIG. 3). The engagement hole 21*d* of the front case body 21 is then fitted over the engagement projection 22*a* of the rear case body 22. The storage space 4 is thus put into a closed off state (refer to FIG. 4). It is then possible to take the film-with-lens 1 out of the case storage space 4 by taking the engagement hole 21*d* off from the engagement projection 22*a*.

According to the camera case of this embodiment, since there are holes, such as the lens hole 211 etc., and cut-away sections, such as the shutter button cut-away section 218, it is possible to carry out operations required to take pictures, such as winding on the film and pressing the shutter button, without removing the camera from the case.

Also, with the camera case of this embodiment, the bent section 216 is provided on the front case body 21 as an inhibiting section. By doing this, transmission of light discharged from the flash 12 is inhibited by the bent section 216, even if the light gets into the inside of the front case body 21. This is because if a light transmission member is bent, light will leak out at the curved section. There is therefore the advantage that it is possible to reduce the amount of light that is discharged from the flash 12 that goes around the lens 11. In this way, with the camera case of this embodiment, it is possible to improve the quality of obtained pictures.

Further, with this embodiment, a rib 217 is provided on the front case body 21 as an inhibiting section separate from the bent section 216. If the rib 217 is not provided, light discharged from the flash 12 is reflected at the inner surface of the camera case and may be forced around the lens 11. With the camera case of this embodiment, however, since the rib 217 is provided, it is possible to reflect or reduce light that is heading in the direction of the lens 11. Accordingly, with the camera case of this embodiment it is possible to improve the quality of obtained pictures.

Also, with the camera case of this embodiment, since the rib 217 is arranged in a vertical direction, light from the flash 12 going towards the lens 11 can be efficiently blocked out.

Further, with the camera case of this embodiment, since the rib 217 is attached at a position closer to the lens 11 than the step shaped bent section 216, it is possible to make the case body 2 thinner compared to the case where the rib 217 is attached at a position closer to the flash 12 than the curved section 216.

Moreover, with the camera case of this embodiment, since the rib 217 is attached at a position closer to the lens 11 than the step shaped bent section 216, it is possible to bring the front case body 21 in the vicinity of the flash 12 closer to the flash 12 (refer to FIG. 4). If the front case body 21 is removed from the flash 12, the amount of light coming into the inside of the front case body 21 from the flash hole 212 is increased. This is because light emitted from the flash 12 spreads in radiation at a particular angle. With this embodiment, by bringing the front case body 21 close to the flash 12, it is possible to reduce the amount of light getting into the front case body 21.

Further, since with this embodiment the flash hole 212 is a through hole, it is possible to reduce the amount of light getting into the front case body 21 compared to when the flash hole is blocked using a transparent material such as resin or the like.

Also, with this embodiment, since the indented section 21*f* is provided on the front case body 21, it is possible to reduce the amount of light from the flash 12 going through the inside of the front case body 21 towards the lens 11. Similarly, since the indented section 21*g* is provided in the front case body 21, it is possible to reduce the amount of light from the flash 12 going through the inside of the front case body 21 towards the distance sensor 15.

Figure 20A:
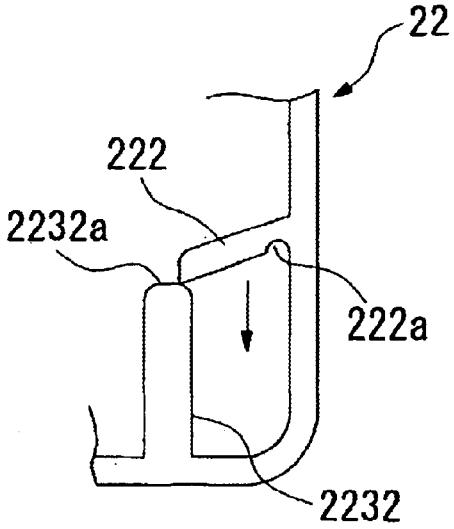
FIG. 20 is an explanatory drawing for describing movement of support pieces of the embodiment, FIG. 20A schematically showing a stage during movement, and FIG. 20B schematically showing a state after movement.

The camera case of this embodiment also has support pieces 221 and 222 for supporting a strap 3. If a strong tensile force is applied to the strap 3, the support pieces 221 and 222 are deformed so as to collapse, as shown in FIG. 20A (only the support piece 222 is shown in the drawing). Here, resistance (strength) of the support pieces 221 and 222 against the tensile force can be designed based on whether or not there are weakening sections 221*a*, 222*a*, and on the shape and material selection of the support pieces 221 and 222. With this embodiment, since the weakening sections 221*a* and 222*a* are provided, the support pieces 221 and 222 collapse with the weakening sections 221*a* and 222*a* as fulcrums. If this is implemented, upper sections of the support pieces 221 and 222 come into contact with contact sections 2231*a* and 2231*a* of the ribs 2231 and 2232. In this way, if there is a light tensile force it is possible to mitigate the tensile force by allowing slight deformation of the support pieces 221 and 222. Also, since the strap 3 is maintained in a state of being supported by the support pieces 221 and 222, it is possible to prevent loss of the strap 3.

Figure 20B:
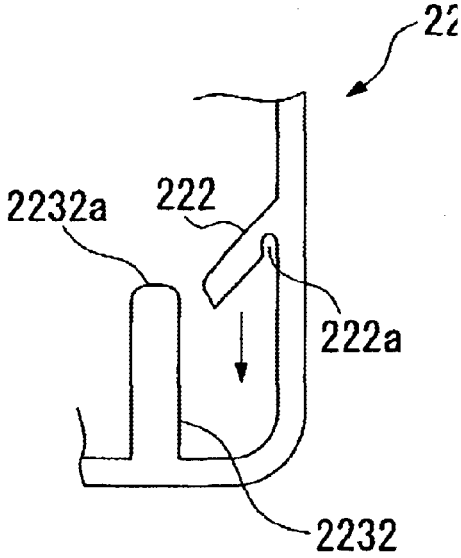

If the tensile force is excessive, the support pieces 221 and 222 shift by climbing over the contact sections 223*a* and 223*b* (refer to FIG. 20B). If this happens, the strap 3 is in a state where it can move by climbing over the support pieces 221 and 222. In this way, the strap 3 can be separated from the case body 2. Accordingly, with the camera case of this embodiment, if an excessive tensile force is applied between the strap 3 and the case body 2, it is possible to detach at least one end of the strap 3 from the case body 2. By doing so, it is possible to reduce the risk of a large tensile force acting on the user.

Figure 21:
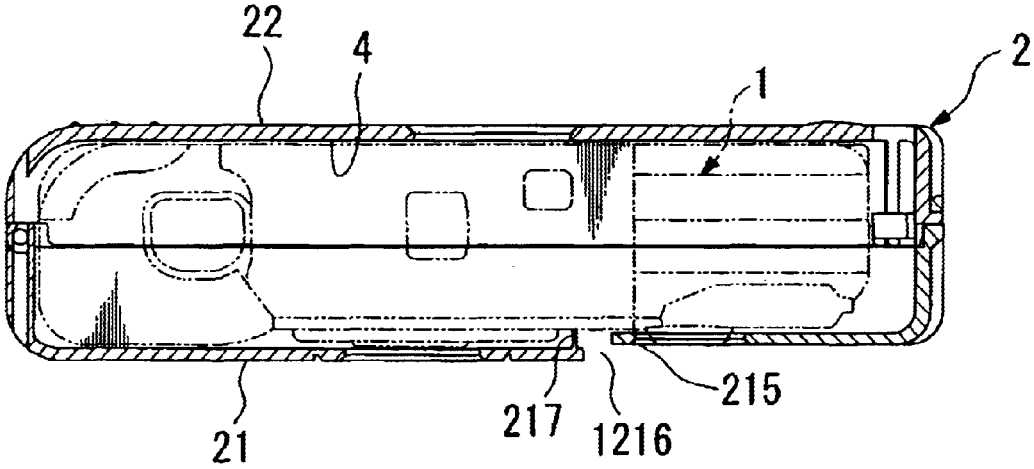
FIG. 21 is a drawing for describing an example of the embodiment provided with a slit, and is a cross section of a similar position to that of FIG. 4.

In the described embodiment, the bent section 216 has been provided as the inhibiting section. However, it is also possible to form a slit 1216 in the front case body 21 instead of the bent section 216 (refer to FIG. 21). The slit 1216 is formed, for example, passing through the front case body 21. However, it is not necessary for the slit to penetrate, and it is actually possible to form the slit 1216 by making it of sufficient thickness to inhibit transmission of light.

By forming the slit 1216, it is possible to more efficiently reduce light from the flash 12 being forced via the case body 2 towards the lens 11 or distance sensor 15. By reducing the light being forced into the distance sensor 15, it is possible to allow the sensor 15 to be operated accurately. It is preferable to position the slit 1216 between the flash 12, and the lens 11 and distance sensor 15. The length of the slit 1216 can be set appropriately based on a relationship between required strength of the case body 2 and the effect of stopping light that goes around.

The disclosures of each of the embodiments described above are only examples, and do not indicate the essential structure of the present invention. The structure of each part is not limited to the above as long as it is possible to achieve the spirit of the present invention. For example, it is possible to have a film-with-lens stored in the case body 2 that does not have a distance sensor 15.

According to the invention of this application, it is possible to obtain a camera case that can bring about improved picture quality.

According to other inventions of this application, it is possible to obtain a camera case where it is possible to smoothly detach a strap from the camera case body.

What is claimed is:

1. A camera case, having a camera storage space and an inhibiting section in the form of a slit formed in the camera case, the inhibiting section being constructed to inhibit light emitted from a camera flash stored in the storage space from being transmitted to a lens of the camera.

2. The camera case of claim 1, further provided with a transparent section for a lens and a transparent section for a flash, the transparent section for a lens and the transparent section for a flash being arranged at positions opposite to a camera lens and a flash stored in the storage space, and the inhibiting section being arranged between the transparent section for a lens and the transparent section for a flash.

3. The camera case of claim 2, where in the transparent section for a flash is a through hole.

4. A camera case, having a camera storage space and an inhibiting section in the form of a slit formed in the camera case, the inhibiting section being constructed to inhibit light emitted from a camera flash stored in the storage space from being transmitted to a sensor of the camera, the camera case also having a transparent section for a flash and a transparent section for a sensor, the transparent section for a flash and the transparent section for a sensor being arranged at positions corresponding to a flash and a sensor stored in the storage space, and the inhibiting section being arranged between the transparent section for a flash and the transparent section for a sensor.

5. A camera case of claim 4, wherein the sensor is a distance sensor.

6. A camera case, having a camera storage space, an inhibiting section, a transparent section for a lens and a transparent section for a flash, the inhibiting section is a rib projecting in an inward direction and vertical direction of the storage space and extends close to upper and lower ends of the storage space, the inhibiting section constructed to inhibit light emitted from a camera flash stored in the storage space from being transmitted to a lens of the camera, the transparent section for a lens and the transparent section for a flash separated in the horizontal direction.

7. A camera case, having a camera storage space, an inhibiting section, a transparent section for a lens and a transparent section for a flash, the inhibiting section being constructed to inhibit light emitted from a camera flash stored in the storage space from being transmitted to a lens of the camera, the inhibiting section further comprises a rib projecting towards the inside of the storage space and a bent section formed by bending the camera case itself, the bent section being formed in a step shape having a section at the camera flash side further inwards than a section at the camera lens side, and the rib being arranged closer to the lens than the bent section, the transparent section for a lens and the transparent section for a flash being arranged at positions opposite to a camera lens and a flash stored in the storage space, the inhibiting section being arranged between the transparent section for a lens and the transparent section for a flash.

8. A camera case, having a camera storage space, an inhibiting section, a transparent section for a flash and a transparent section for a sensor, the inhibiting section being constructed to inhibit light emitted from a camera flash stored in the storage space from being transmitted to a sensor of the camera, the inhibiting section is an indented section formed around the transparent section for a sensor, the transparent section for a flash and the transparent section for a sensor being arranged at positions corresponding to a flash and a sensor stored in the storage space, and the inhibiting section being arranged between the transparent section for a flash and the transparent section for a sensor.

* * * * *